US007341149B2

(12) United States Patent
DeAntoni

(10) Patent No.: US 7,341,149 B2
(45) Date of Patent: Mar. 11, 2008

(54) PORTABLE TOOL CARRIER FOR A GAS CAN

(76) Inventor: Robert G. DeAntoni, Paradise Hill La., Shingletown, CA (US) 96088-9416

( * ) Notice: Subject to any disclaimer, the term of this patent is extended or adjusted under 35 U.S.C. 154(b) by 245 days.

(21) Appl. No.: 11/223,573

(22) Filed: Sep. 9, 2005

(65) Prior Publication Data

US 2006/0196908 A1 Sep. 7, 2006

Related U.S. Application Data

(60) Provisional application No. 60/658,406, filed on Mar. 2, 2005.

(51) Int. Cl.
*B65D 85/28* (2006.01)
*B65D 25/00* (2006.01)
*A45F 5/00* (2006.01)

(52) U.S. Cl. ..... 206/373; 220/735; 224/679; 224/904

(58) Field of Classification Search ..... 206/373; 220/694–694.1, 735; 222/192; 224/148.4, 224/682–684, 625–627, 675–681
See application file for complete search history.

(56) References Cited

U.S. PATENT DOCUMENTS

| | | | | |
|---|---|---|---|---|
| 1,353,236 | A * | 9/1920 | Hatfield | 220/694.1 |
| 3,979,034 | A * | 9/1976 | Larman | 224/652 |
| 4,765,472 | A * | 8/1988 | Dent | 206/373 |
| 5,797,528 | A * | 8/1998 | McDuffie | 224/148.4 |
| 6,325,251 | B1 * | 12/2001 | Santos | 220/735 |
| 6,390,348 | B1 * | 5/2002 | Godshaw et al. | 224/904 |
| 6,702,168 | B2 * | 3/2004 | Panosian | 220/694 |
| 6,712,251 | B2 * | 3/2004 | Godshaw et al. | 224/675 |
| 7,011,241 | B2 * | 3/2006 | Godshaw et al. | 224/677 |
| 2005/0029272 | A1 * | 2/2005 | Padilla | 220/735 |
| 2005/0205633 | A1 * | 9/2005 | Godshaw et al. | 224/625 |

* cited by examiner

*Primary Examiner*—Bryon P Gehman
(74) *Attorney, Agent, or Firm*—Buchanan Ingersoll & Rooney PC

(57) ABSTRACT

A portable tool carrier for a gas can includes an adjustable carrier strap adapted to surround a side surface of the gas can, a pair of adjustable support straps adapted to go over an upper surface of the gas can, and at least one pocket, wherein the at least one pocket is partially attachable to the carrier strap and forming at least one pocket on the side of the gas can.

20 Claims, 5 Drawing Sheets

PORTABLE TOOL CARRIER FOR A GAS CAN

CROSS REFERENCE TO RELATED APPLICATIONS

This application claims priority to U.S. Provisional Patent Application Ser. No. 60/658,406, filed Mar. 2, 2005, which is incorporated herein by reference in its entirety.

BACKGROUND

There are presently a variety of carrying devices on the market designed to store and transport tools. For example, many companies sell rigid tool boxes that have a hinged top and a removable tray that lifts out for accessing a lower interior area designed for bulk tool storage. Other, similar tool boxes may include small drawers for storing smaller tools or parts. However, these types of tool boxes are usually designed to store tools horizontally, often resulting in a disorganized mass of tools in a single storage area in the bottom of the tool box. This arrangement can make selection and accessing of the stored tools somewhat difficult and potentially dangerous.

Another disadvantage of rigid tool boxes such as those described above is that, often, they do not conform to storage areas provided in vehicles. Usually tradesmen transport or store tool boxes in their vehicles, however, enough space for a rectangular hard tool box is often not available.

Other tool storage products available are fabric bags similar to doctor's bags having a zippered opening providing access to an inside cavity for storing tools. However, tools stored in this type of bag are also generally stored together, horizontally, in a single storage area. Inner pockets may be provided, although access to the inner pockets can be substantially restricted when the bag is full or partially full of tools.

Most fabric tool bags available offer an alternative to the rigid tool carriers described above, but do not overcome the problems associated with bulk tool storage. Also, when storing or transporting sharp tools horizontally or in pockets, in a purely fabric bag, the bag can easily be damaged by the tools.

Another tool storage system available is a bag designed to fit over an empty 5-gallon plastic bucket. This type of bag often has a variety of tool pockets designed to fit both on the inside and outside of the bucket. The bucket provides a frame and supports the tool bag.

However, none of these carriers are designed to fit over plastic gas cans and the like. Accordingly, it would be desirable to have a portable carrier, which fits over a variety of plastic gas cans from 2½ to 5 gallons and is capable of carrying a variety of products used when operating a chain saw, weed whacker or the like.

SUMMARY

In accordance with one embodiment, a tool carrier for a gas can comprises: an adjustable carrier strap adapted to surround a side surface of the gas can; a pair of adjustable support straps adapted to go over an upper surface of the gas can; and at least one pocket, wherein the at least one pocket is partially attachable to the carrier strap and forming at least one pocket on the side surface of the gas can.

In accordance with a further embodiment, a tool carrier for a gas can comprises: an adjustable first strap adapted to surround a side surface of the gas can; a pair of adjustable second straps adapted to go over an upper surface of the gas can, each of the second straps attached to the first strap at an approximate right angle; and at least one pocket, wherein the at least one pocket is partially attachable to the first strap and forming at least one pocket on the side surface of the gas can.

In accordance with another embodiment, a tool carrier comprises: an adjustable first strap adapted to surround a side surface of a gas can; an adjustable second strap adapted to go over an upper surface of the gas can, the second strap attached to the first strap at an approximate right angle; and at least one pocket, wherein the at least one pocket is partially attachable to the first strap and forming at least one pocket on the side surface of the gas can.

DETAILED DESCRIPTION

Figure 1:
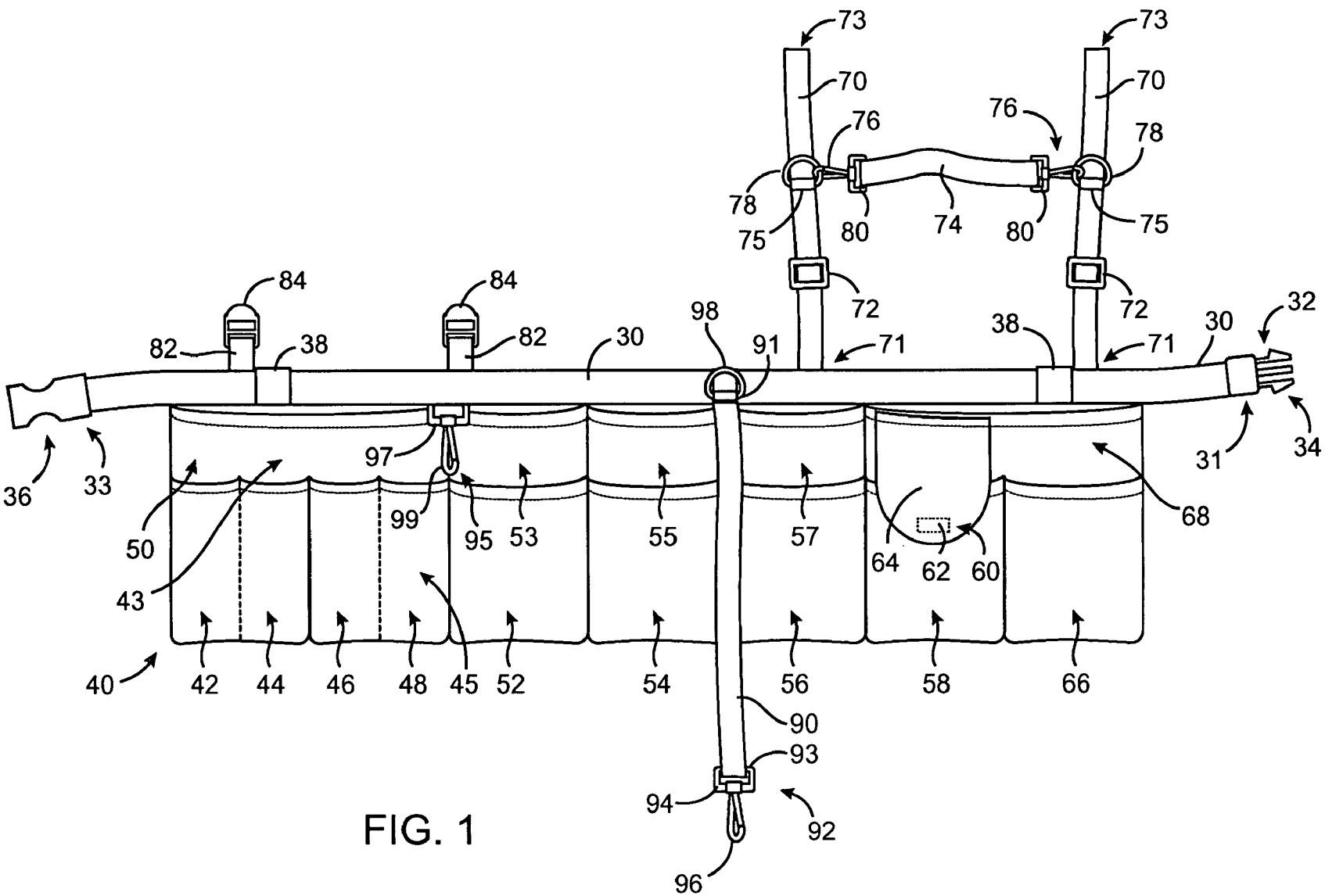
FIG. 1 shows a perspective view of a tool carrier, which fits over a gas cans.
Figure 2:
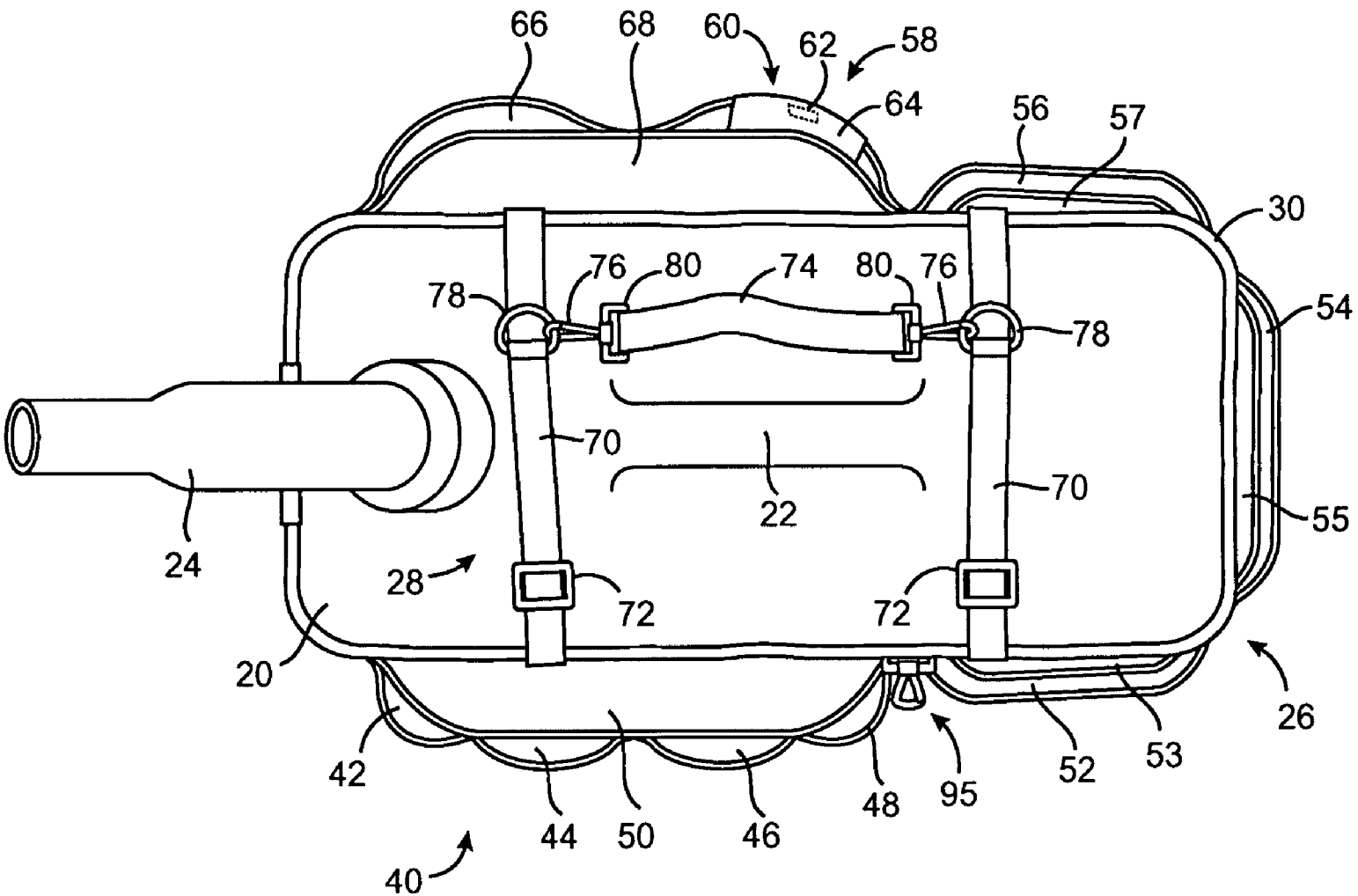
FIG. 2 shows a top view of the tool carrier of FIG. 1 attached to a gas can.

FIG. 1 shows a perspective view of a tool carrier 10, which fits of a variety of gas cans 20 (FIG. 2). As shown in FIG. 1, the tool carrier 10 includes an adjustable carrier strap or first strap 30 adapted to surround an outer or peripheral side surface 26 of the gas can 20, a pair of adjustable support straps or second straps 70 adapted to go over an upper surface 28 of the gas can 20 and at least one pocket 40, wherein the at least one pocket 40 is at least partially attachable to the first strap 30 and forming at least one pocket 40 on the side 26 of the gas can 20.

FIG. 2 shows a top view of the tool carrier 10 of FIG. 1 attached to a gas can 20. As shown in FIG. 2, the gas can 20 preferably includes a handle 22, and a spout 24. The tool carrier 10 is adapted to carry products used when operating a chain saw or other gas power device or apparatus. As shown, the tool or products fit into the at least one pocket of the portable carrier 10, which is adapted to fit over a variety of plastic gas cans 20 from 2½ to 5 gallons. It can be appreciated that the carrier 10 can be adjusted to fit over water cans and other similar devices without departing from the present invention.

As shown in FIG. 1, the tool carrier 10 has an adjustable first strap 30 adapted to surround an outer or peripheral side surface 26 of the gas can 20. The adjustable first strap 30 includes a fastener 32, which is configured to secure the adjustable first strap 30 around the side surface 26 of the gas can 20. The fastener 32 connects a first end 31 of the first strap 30 to a second end 33 of the first strap 30.

As shown in FIG. 1, the fastener 32 can be any suitable heavy-duty side lock and buckle, including a buckle or coupling having a male coupling 34 and a female coupling 36. It can be appreciated that any suitable fastener 32 can be used to secure the first strap 30 around the side surface 26 of the gas can 20. The tool carrier 10 can preferably be removably secured to the traditional gas can rate 20 quickly and conveniently, in a variety of ways. For instance, fasteners 30 can be a buckle or snap-fastener 32 comprising male snap members 34 and female snap members 36. Alternatively, hook and loop fasteners, elastic tie downs and other suitable fasteners 30 can be used.

As shown in FIG. 1, the first strap 30 has at least one strapping loop 38 and more preferably at least two strapping loops 38 to secure the at least one pocket 40 to the first strap 30. The at least one strapping loop 38 loops around the first strap 30 and is attachable to the at least one pocket 40. The at least one strapping loop 38 can be fixed to the at least one pocket 40 or can be attachable via Velcro®, or other suitable attachment means.

The tool carrier 10 is configured to attach or fit on gas cans 20 or other suitable cans having a handle 24, a side surface 26, and an upper surface 28. The side surface 26 of the can 20 can include two sides, a front and a back portion. The first strap 30 fits around the side surface 26 of the gas can 20. A pair of adjustable support straps or second straps 70 extends from the first strap 30 at first point 35. The second straps 70 are attached to the first strap 30 and include a handle or third strap 74 extending between the pair of support or second straps 70. The second straps 70 are attached to the first strap 30 at a first end 71 and have a second end 73, which is configured to attach to the first strap 30 via a strap adjuster 84. The second straps 70 can also be fitted with a second strap adjuster 72, which is positioned between the handle strap 74 and the first point 71. The second strap adjuster 72 is configured to adjust the second straps 70 so that it can be positioned an equal distance from the first point 71 of the first strap 30 and the second point 73 of the first strap 30 when the carrier 10 is fitted on different size gas cans 20. It can be appreciated that rather than a pair of support or second straps 70, a single support strap 70 (FIG. 7) can be used. In an alternative embodiment, the pair of support straps or second straps 70 can be more than two. For example, with certain gas cans 20, it may be desirable to have three (3) or more support or second straps 70.

The strap adjuster 84 is preferably a buckle or other suitable apparatus, which can alter or change the length of the second straps 70 so that the second straps 70 fit tightly across the upper surface 28 of the gas can 20. The strap adjuster 84 is preferably attached to the first strap 30 via a short strap 82 or other suitable device. The short strap 82 is attached to the first strap 30 at a second point 37. The short strap 82 and strap adjuster 84 preferably extend from the first strap 30 at a 90 degree angle, so that the strap adjuster 84 receives the second end 73 of the second straps 70 at a desirable angle to insure that the second straps 70 can be tighten to fit snugly or tightly across the upper surface 38 of the gas can 20. The second straps 70 is preferably perpendicular to the first strap 30 and extend from the first strap 30 at 90 degree angles. Each of the second straps 70 includes a strap adjuster 72 for adjusting the tool carrier 10 to fit gas cans of different sizes.

The handle strap 74 fits between the second straps 70. As shown in FIG. 1, the handle strap 74 is preferably attached to the second straps 70 with a ring 78, which is attached to the second straps 70 and a swivel snap hook 76, which is shown on each end 80 of the handle strap 74. The ring 78 in combination with the snap hook 76 provides for ease of handling by allowing the handle strap 74 to move freely in any direction. The ring 78 is preferably an O-shaped or D-shaped ring; however, any suitable shape can be used. It can also be appreciated that the ring 78 and snap hook 76 can be replaced by any suitable fasteners or can be sewn or permanently attached to the second straps 70 without departing from the present invention.

The at least one pocket 40 preferably includes a plurality of pockets 42, 44, 46, 48, 50, 52, 54, 55, 56, 57, 58, 66, and 68 configured to receive any number of items that may be needed. It can be appreciated that although the at least one pocket 40 is shown with a plurality of pockets 42, 44, 46, 48, 50, 52, 54, 55, 56, 57, 58, 66, and 68, the number of pockets can varying depending on the each individuals desires and as such the at least one pocket 40 is merely an example of one configuration. As shown in FIG. 1, the at least one pocket 40 can include a plurality of pockets 42, 44, 46, 48, 50, 52, 54, 55, 56, 57, 58, 66, and 68 designed to have specific sizes and shapes to accommodate various tools so that the appropriate tools fit snugly therein. Desirably, the tool carrier 10 has a plurality of pockets surrounding three of the four peripheral side surface or sides 26 of the gas can 20. Preferably as shown in FIG. 2, the tool carrier 10 does not include pockets 40 beneath the spout 24 of the gas can 20. As shown in FIG. 1, the plurality of pockets 42, 44, 46, 48, 50, 52, 54, 55, 56, 57, 58, 66, and 68 can be formed in rows adjacent to and supported by a rear panel 41, a middle panel 43 and a front panel 45. The middle and front panels 43, 45 form a first row of pockets 42, 44, 46, 48, 52, 54, 56, 58 and 66. The rear and middle panels 41, 43 form a second row of pockets 50, 53, 55, 57 and 68. The rows of tool pockets 40 can be tiered providing tool pockets for longer tools to be stored in the second row of tool pockets and smaller tools to be stored in first rows of tool pockets. It can be appreciated that the tool carrier 10 can also include additional tool pockets formed on the rear, middle or front panels 41, 43, 45, on either the interior or on the exterior panels thereof.

For example, in one embodiment of a tool carrier 10 adapted for use with a chainsaw, the tool carrier 10 as shown in FIG. 1, can includes a pocket for brush or wrench (not shown); a pocket for 1 US quart bar or chain oil 50, 68; a pocket for plastic wedge 53; a pocket for spare chain saw chain 55, 57; a pocket for safety glasses 42; a pocket for spark plug 44, 46; a pocket for Push n'Lube® 48; a pocket for one 6.4 fluid ounce two stroke oil 52, 56; and spare pockets 58, 66. As shown in FIG. 1, one of the spare pockets 58 includes a Velcro® cover 60 having a cover or flap 64, which is secured to the pocket 58 with a Velcro patch 62. In an alternative embodiment, the flap 64 can include a pair of cooperating fasteners attached thereto so that the flap 64 can fold on itself and be secured in one or more positions when the pocket is open. It can be appreciated that zippers or any suitable cooperating fastener can be used with the flap 64.

In an alternative embodiment, the at least one pocket 40 can include any suitable attachment apparatus, which allows the at least one pocket be removably attached to the tool carrier 10. Thus, the user may interchange different tool carrier 10 with several different configuration of at least one pocket 40 for gas cans 20 of different size and shapes, and according to what implements or tools are required for a particular job. The at least one pockets 40 of the tool carrier 10 can also include a closing means which functions to securely contain implements therein. For instance, each of the at least one pockets 40 can include a snap-closing means, hook and loop fastening means, or zipper assembly to effectively contain substantially small items that may otherwise be easily misplaced.

The tool carrier 10 can also include an alternative strap 90 having a ring 98 attached to the first strap 30 and a swivel snap hook 92 attached to a free end 93 of the alternative strap 90. The ring 98 is preferably D-shaped or O-shaped, however, any suitable shaped ring can be used. The swivel snap hook 92 preferably includes a fastener 94 attached to the free end 93 of the alternative strap 90 and a hook 96 attached thereto. It can be appreciated that any suitable fasteners can be used in place of the ring 98 and swivel snap hook 92. The tool carrier 10 can also include a second swivel snap hook 95, which is attached to either the first strap 30 by any suitable means or can be attached to any one of the plurality of pockets 40. The second swivel snap hook 95 is comprised of a fastener 97 attached to either the first strap 30 or the plurality of pockets 40 and a hook 99. The second swivel snap hook 95 is preferably designed to receive a key ring.

The carrier 10 can be made out of a heavy-duty polyester material, leather, Dupont® Cordura Plus™ sewn with a reinforced stitching using heavy duty or strong thread. As shown in FIG. 1, the carrier 10 has at least one heavy-duty adjustable side lock/buckle in the front for easy removal and installation, which goes around the gas can 20. A pair of support straps or second straps 70 to go over the gas can, which supports the portable carrier 10 with a handle. The two support straps 70 are fully adjustable so that the portable tool carrier 10 can fit onto different size plastic gas cans 20.

FIG. 2 shows a top view of the tool carrier 10 of FIG. 1 attached to a gas can 20. As shown in FIG. 2, the first strap 30 wraps around the side surface 26 of the gas can 20. The first strap 30 preferably includes an adjustable heavy duty fastener 32 having a male and female buckle 34, 36. The first strap 30 fits tightly around the side surface 26 of the gas can 20. The adjustable fastener 32 allows for the tool carrier 10 to adjust to any size gas can 20. Once the first strap 30 is attached tightly to the peripheral or outer side surface 26 of the gas can 20, the second straps 70 are attached to the upper portion or surface 28 of the gas can 20. Once again using the strap adjusters 72, 84, the handle 22 of the gas can 20 is preferably positioned an equal distance from the at least one tool pocket 40, which is attachable to the first strap 30. The handle strap 74 can be positioned slightly off center as shown in FIG. 2 depending on the size of the gas can 20 if the handle strap 74 is permanently attached to the second straps 70. Alternatively, the handle strap 74 can include a floating fastener, which can move to any relative position along the second straps 70. It can also be appreciated that in an alternative embodiment, the handle strap 74 can be an ergonomically designed handle and includes a soft grip to provide comfort to the user when carrying the tool carrier 10.

Figure 3:
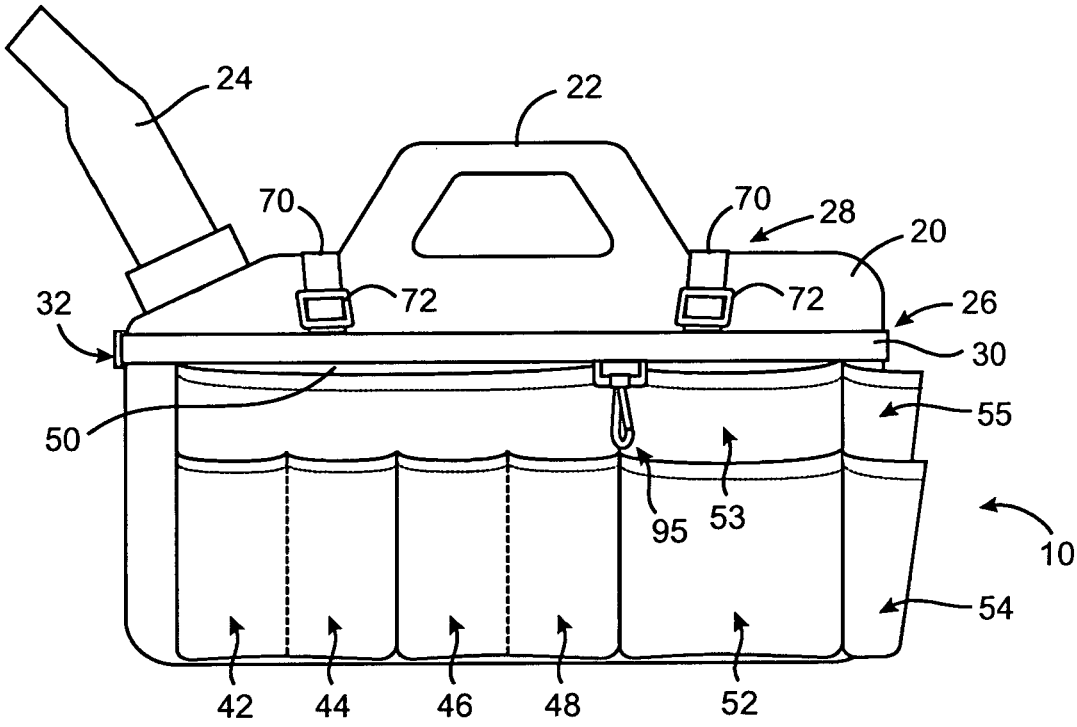
FIG. 3 shows a side view of the tool carrier of FIG. 1

FIG. 3 shows a side view of the tool carrier of FIG. 1. As shown in FIG. 3, the tool carrier 10 includes a plurality of pockets 40, which are attached to the gas can 20 with an adjustable carrier or first strap 30 and a pair of support or second straps 70. The second straps 70 are configured to fit over the upper surface 28 of the gas can 20 and can be adjusted with the strap adjusters 72, 84. The handle 22 of the gas can 20 is preferably positioned an equal distance from the at least one tool pocket 40, which is attachable to the first strap 30. The first strap 30 wraps around the side surface 26 of the gas can 20. The first strap 30 preferably includes an adjustable heavy duty fastener 32 having a male and female buckle 34, 36. The first strap 30 fits tightly around the side surface 26 of the gas can 20.

Figure 4:
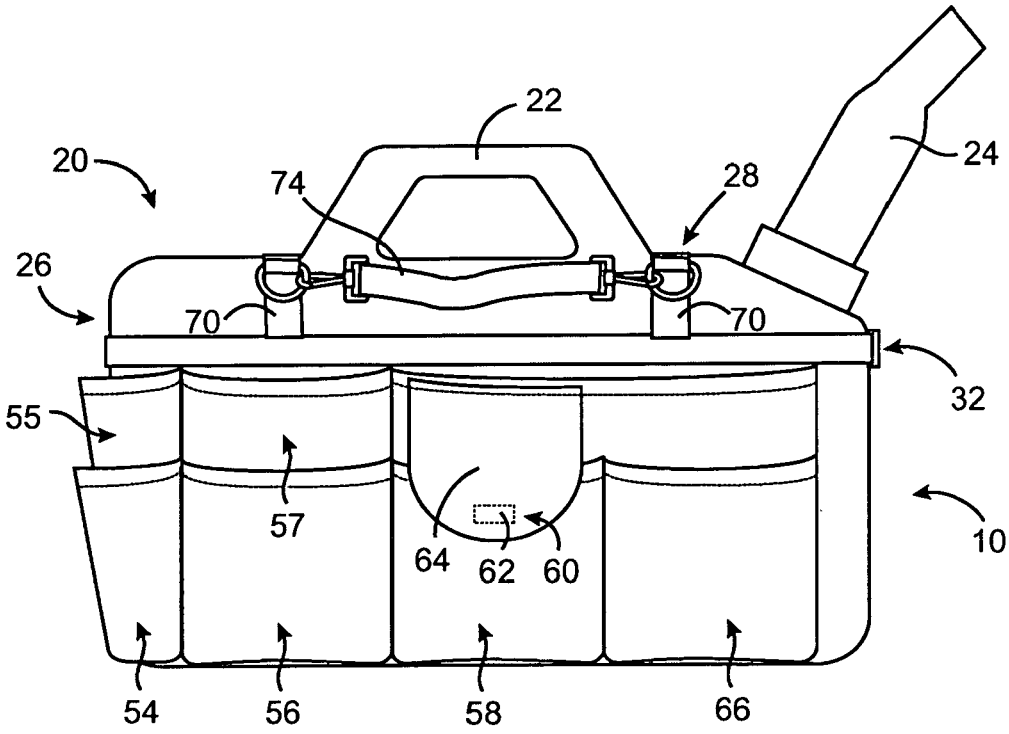
FIG. 4 shows another side view of the tool carrier of FIG. 1.

FIG. 4 shows another side view of the tool carrier of FIG. 1. As shown in FIG. 4, the handle or third strap 74 is secured to the support or second straps 70 with a ring 78 having preferably an O-shape or D-shape. The ring 78 allows for the handle or third strap 74 to rotate for ease of use.

Figure 5:
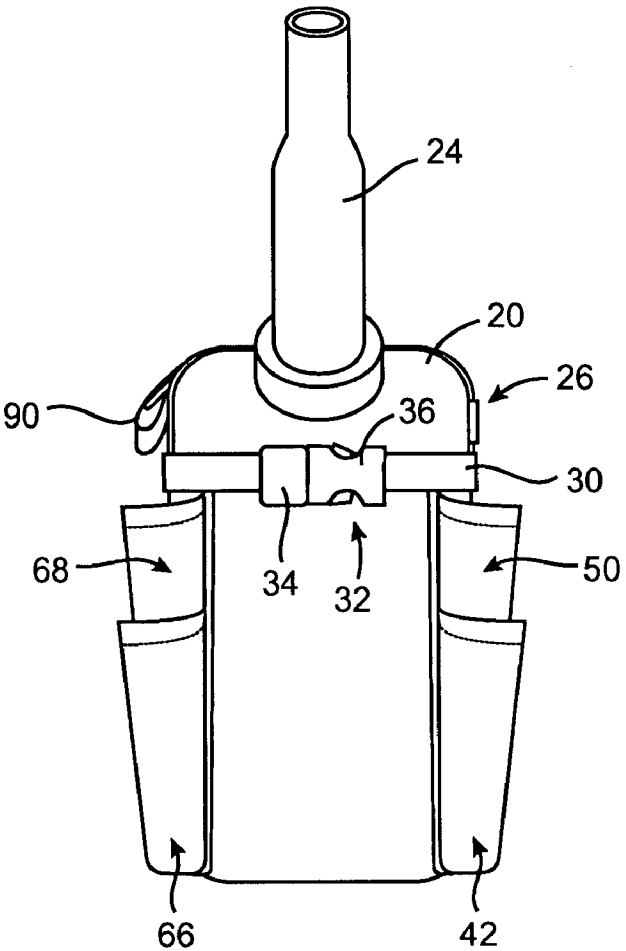
FIG. 5 shows a front view of the tool carrier of FIG. 1.

FIG. 5 shows a front view of the tool carrier of FIG. 1. As shown in FIG. 5, the carrier or first strap 30 fits tightly around the side surface 26 of the gas can 20 and is fastened underneath the spout 24 of the gas can 20. It can be appreciated the that carrier 10 can also be fitted with a first strap 30 adapted to fastener to the gas can 20 around any peripheral or side of the gas can 20 and it is not always necessary for the carrier or first strap 30 to fasten underneath the spout 24. For example, the carrier or first strap 30 can fasten on the sides or back/end of the gas can 20.

Figure 6:
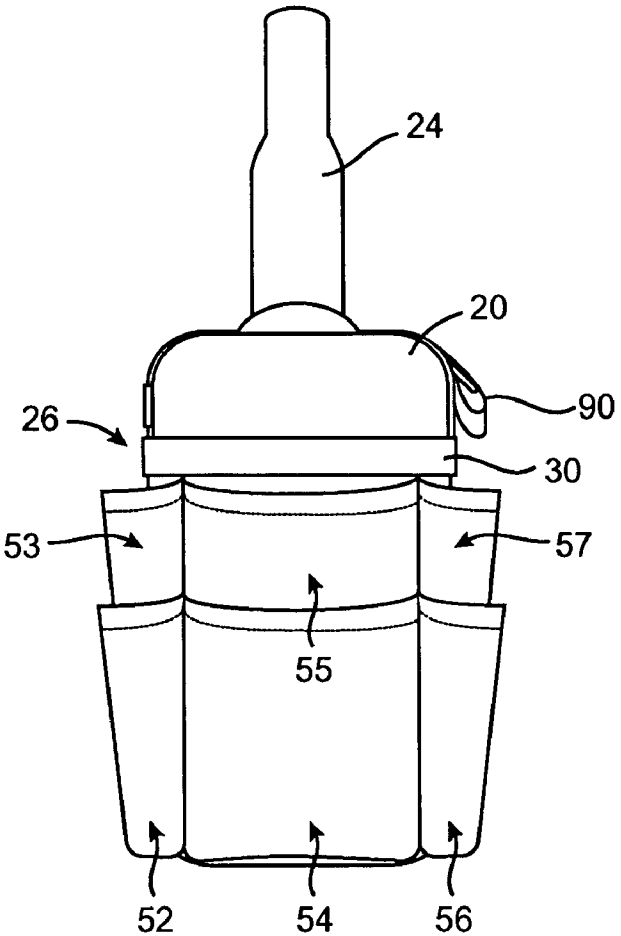
FIG. 6 shows an end view of the tool carrier of FIG. 1.

FIG. 6 shows an end view of the tool carrier of FIG. 1. As shown in FIG. 6, the tool carrier 10 wraps around the gas can 20 and is attached via the carrier or first strap 30 and a pair of support or second straps 70. The carrier 10 can also includes an alternative strap 90 having a ring 98 attached to the first strap 30 and a swivel snap hook 92 attached to a free end 93 of the alternative strap 90.

Figure 7:
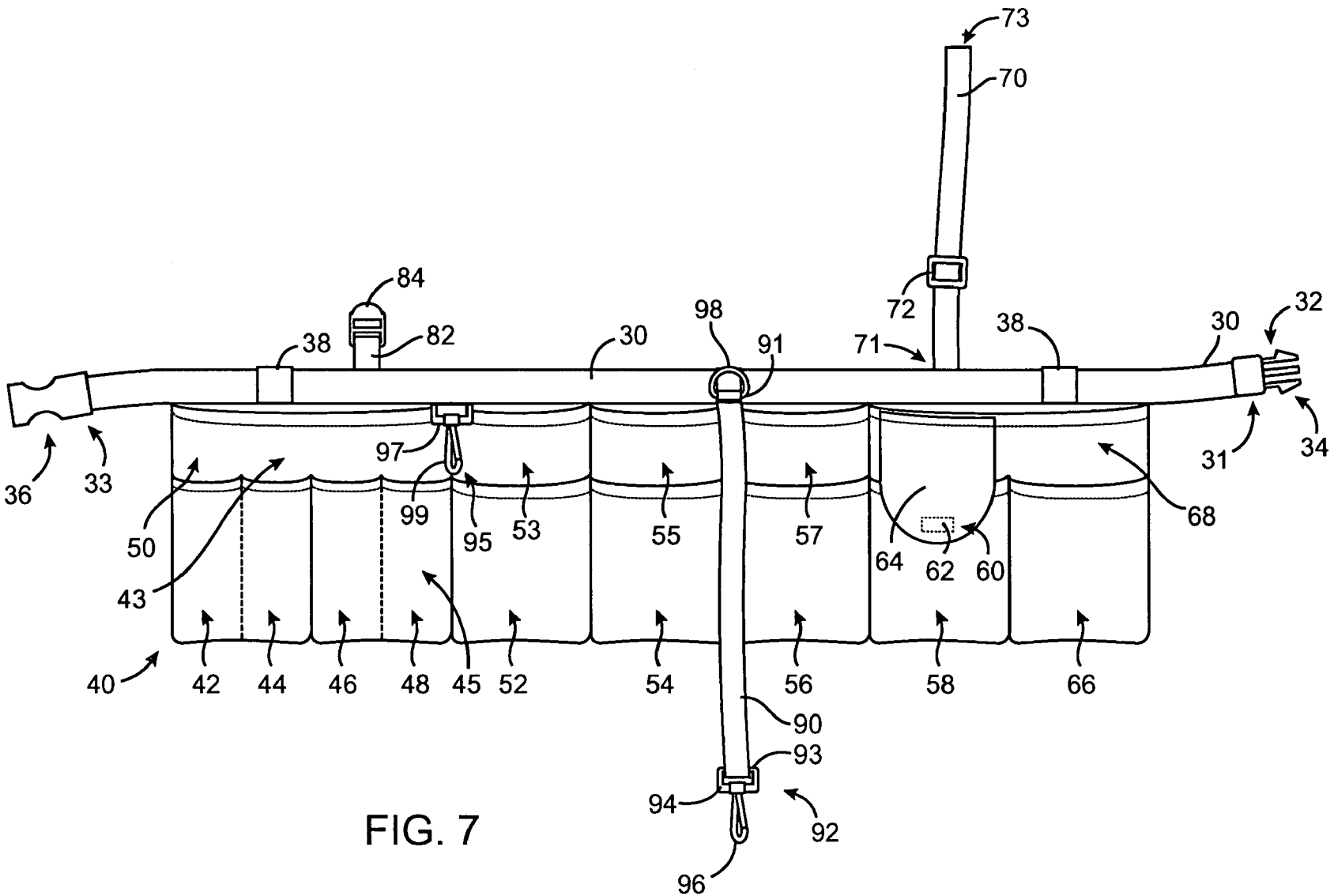
FIG. 7 shows a perspective view of an alternative embodiment of the tool carrier of FIG. 1.

FIG. 7 shows a perspective view of an alternative embodiment of the tool carrier of FIG. 1. As shown in FIG. 7, the tool carrier 10 includes an adjustable carrier strap or first strap 30 adapted to surround a side surface or side 26 of the gas can 20, an adjustable support straps or second strap 70 adapted to go over an upper surface 28 of the gas can 20 and at least one pocket 40, wherein the at least one pocket 40 is at least partially attachable to the first strap 30 and forming at least one pocket 40 on the side 26 of the gas can 20. The support strap or second strap 70 can also have different widths to accommodate gas can 20 of different sizes. In one embodiment, the support strap or second strap 70 will preferably be the width of the inner portion of the handle 22 on the gas can 20, which improves the ability of the tool carrier 10 to fit tightly around the periphery of the sides 26 of the gas can 20 and over the upper surface 28 of the gas can 20.

The tool carrier 10 is preferably manufactured from a heavy duty polyester material, such as nylon, leather, Dupont Cordura Plus and sewn with a reinforced stitch using heavy duty and/or strong thread. However, it can be appreciated that the tool carrier 10 can be constructed of any suitable material without departing from the present invention. In addition, it should be appreciated that the first, second and third straps 30, 70 and 74 are preferably constructed of one type of material such as nylon or polyester and the at least one pocket 40 is made from nylon, polyester or leather or a combination thereof.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. A tool carrier for a gas can having four peripheral side surfaces comprising:

an adjustable carrier strap, which surrounds the four peripheral side surfaces of the gas can;

a pair of adjustable support straps, the pair of adjustable support straps extending across an upper surface of the gas can; and at least one pocket, wherein the at least one pocket is partially attachable to the carrier strap and forming at least one pocket on the four peripheral side surfaces of the gas can.

2. The carrier of claim 1, wherein the carrier strap further comprises a fastener for connecting a first end of the carrier strap to a second end of the carrier strap.

3. The carrier of claim 1, wherein the pair of support straps further comprises a means for connecting a first end of the pair of support straps to a fastener of a short strap.

4. The carrier of claim 1, further comprising a handle strap attached to each of the pair of support straps.

5. The carrier of claim 1, wherein the at least one pocket comprises a plurality of pockets, at least one of said pockets being positioned within another of said pockets such that an outer surface of said at least one of said pockets forms an inner surface of said another of said pockets, each of said pockets being at least partially coupled to the carrier strap.

6. The carrier of claim 1, further comprising a gas can comprised of four peripheral side surfaces, a lower surface and an upper surface having a handle and a spout, and wherein the pair of adjustable support straps extend tightly across the upper surface of the gas can.

7. The carrier of claim 6, wherein the tool carrier has a plurality of pockets surrounding three of the four peripheral side surfaces of the gas can.

8. The carrier of claim 7, wherein the carrier does not include at least one pocket beneath the spout of the gas can.

9. The carrier of claim 7, wherein the carrier extends around the four peripheral side surfaces of the gas can including a front side surface, a pair of side surfaces, and a back side surface.

10. A tool carrier for a gas can having four peripheral side surfaces comprising:

an adjustable first strap, which surrounds the four peripheral side surfaces of the gas can;

a pair of adjustable second straps, which extend across an upper surface of the gas can, each of the second straps attached to the adjustable first strap at an approximate right angle; and at least one pocket, wherein the at least one pocket is partially attachable to the first strap and forming at least one pocket on the four peripheral side surfaces of the gas can.

11. The carrier of claim 10, wherein the first strap further comprises a fastener for connecting a first end of the first strap to a second end of the first strap.

12. The carrier of claim 10, wherein the pair of second straps further comprises a means for connecting a first end of the pair of second straps to a fastener on an end of a short strap.

13. The carrier of claim 10, further comprising a third strap attached to a first point on one of the second straps and a second point on the other one of the second straps.

14. The carrier of claim 10, wherein the at least one pocket comprises a plurality of pockets, at least one of said pockets being positioned within another of said pockets such that an outer surface of said at least one of said pockets forms an inner surface of said another of said pockets, each of said pockets being at least partially coupled to the first strap.

15. The carrier of claim 10, further comprising a gas can comprised of four peripheral side surfaces, a lower surface and an upper surface having a handle and a spout, and wherein the pair of adjustable second straps extend tightly across the upper surface of the gas can on each side of the handle to support the carrier on the gas can.

16. A tool carrier for a gas can having four peripheral side surfaces comprising:

an adjustable first strap, which surrounds the four peripheral side surfaces of the gas can;

an adjustable second strap, which extends across over an upper surface of the gas can, the adjustable second strap attached to the first strap at an approximate right angle; and at least one pocket, wherein the at least one pocket is partially attachable to the first strap and forming at least one pocket on the four peripheral side surfaces of the gas can.

17. The carrier of claim 16, wherein the first strap further comprises a fastener for connecting a first end of the first strap to a second end of the first strap.

18. The carrier of claim 16, wherein the second strap further comprises a means for connecting the second strap to a short strap.

19. The carrier of claim 16, wherein the at least one pocket comprises a plurality of pockets, at least one of said pockets being positioned within another of said pockets such that an outer surface of said at least one of said pockets forms an inner surface of said another of said pockets, each of said pockets being at least partially coupled to the first strap.

20. The carrier of claim 16, further comprising further comprising a gas can comprised of four peripheral side surfaces, a lower surface and an upper surface having a handle having an inner portion and a spout, and wherein the adjustable second strap fits within the inner portion of the handle.

* * * * *